US009498089B2

(12) United States Patent
Shankar et al.

(10) Patent No.: US 9,498,089 B2
(45) Date of Patent: Nov. 22, 2016

(54) SUSTAINABLE MINI SHOWER

(71) Applicant: Conopco, Inc., Englewood Cliffs, NJ (US)

(72) Inventors: Venkatesh Shankar, Bangalore (IN); Shailendra Pratap, Bangalore (IN); Rajeesh Kumar Ramachandran, Bangalore (IN); Nimish Harshadrai Shah, Bangalore (IN)

(73) Assignee: Conopco, Inc., Englewood Cliffs, NJ (US)

( * ) Notice: Subject to any disclaimer, the term of this patent is extended or adjusted under 35 U.S.C. 154(b) by 22 days.

(21) Appl. No.: 14/437,843

(22) PCT Filed: Oct. 9, 2013

(86) PCT No.: PCT/EP2013/071025

§ 371 (c)(1),
(2) Date: Apr. 23, 2015

(87) PCT Pub. No.: WO2014/067751

PCT Pub. Date: May 8, 2014

(65) Prior Publication Data

US 2015/0289725 A1 Oct. 15, 2015

(30) Foreign Application Priority Data

Nov. 1, 2012 (EP) ..... 12190932

(51) Int. Cl.
*A47K 3/00* (2006.01)
*A47K 3/28* (2006.01)
*B05B 7/24* (2006.01)

(52) U.S. Cl.
CPC ..... *A47K 3/288* (2013.01); *B05B 7/2491* (2013.01)

(58) Field of Classification Search
CPC ..... A47K 3/285
USPC ..... 4/616, 615
See application file for complete search history.

(56) References Cited

U.S. PATENT DOCUMENTS 1,982,509 A 11/1934 Frank
2,336,402 A 12/1943 Kaiser (Continued)

FOREIGN PATENT DOCUMENTS

BE 497290 12/1950
CN 101316970 12/2008

(Continued)

OTHER PUBLICATIONS

IPRP2 in PCTEP2013054358 dated Mar. 5, 2013, pp. 1 to 6.

(Continued)

*Primary Examiner* — Huyen Le
(74) *Attorney, Agent, or Firm* — Greenberg Traurig, LLP

(57) ABSTRACT

Disclosed is a sustainable shower apparatus (1) comprising: (i) a pressurizable container (2) to hold water (3) and a gas; (ii) a pressurizer (4) for pressurizing said container; (iii) a shower head (7); (iv) a first tubing for carrying pressurized water from the container to the shower head; (v) a second tubing (8) for carrying pressurized gas from the container to the shower head; where flow of said gas or water is individually controllable by use of respective valves (6, 9) and where each tubing terminates into a respective nozzle (10, 11) in said shower head which comprises a nozzle for spraying said gas and adjacent thereto, at least one nozzle for spraying the water, wherein tip of each nozzle for spraying water is oriented at an acute angle with the tip of nozzle for spraying gas.

14 Claims, 2 Drawing Sheets

(56) References Cited

U.S. PATENT DOCUMENTS

| | | | | |
|---|---|---|---|---|
| 3,760,431 | A | 9/1973 | Schwibner | |
| 3,965,494 | A * | 6/1976 | Baker | B05B 7/0433 4/615 |
| 4,171,094 | A | 10/1979 | Halfen | |
| 4,651,720 | A | 3/1987 | Baus | |
| 4,964,399 | A | 10/1990 | Faimali | |
| 5,065,942 | A | 11/1991 | Shannon | |
| 5,161,266 | A | 11/1992 | Hildebrand | |
| 5,418,985 | A | 5/1995 | Antoine | |
| 5,469,587 | A | 11/1995 | Demeny | |
| 5,911,520 | A | 6/1999 | Kenney | |
| 6,047,416 | A | 4/2000 | Carrier | |
| 7,168,108 | B2 | 1/2007 | Guerin | |
| 8,458,826 | B2 | 6/2013 | Mock | |
| 2002/0096186 | A1 | 7/2002 | Von Halem | |
| 2002/0112738 | A1 | 8/2002 | Parker | |
| 2003/0094509 | A1 | 5/2003 | Venuto, Sr. | |
| 2003/0155466 | A1 | 8/2003 | Wentland | |
| 2003/0163867 | A1 | 9/2003 | Zhou | |
| 2005/0086735 | A1 | 4/2005 | Lim | |
| 2005/0086738 | A1 | 4/2005 | Gragtmans | |
| 2005/0210576 | A1 | 9/2005 | Guerin | |
| 2006/0064815 | A1 | 3/2006 | Guerin | |
| 2006/0275555 | A1 | 12/2006 | Colizza | |
| 2007/0107121 | A1 | 5/2007 | Smith | |
| 2010/0058532 | A1 * | 3/2010 | Tsai | A47K 3/285 4/599 |
| 2013/0001243 | A1 * | 1/2013 | Quick | A47K 3/285 222/135 |
| 2013/0305449 | A1 * | 11/2013 | Allos | A47K 3/288 4/616 |

FOREIGN PATENT DOCUMENTS

| | | | |
|---|---|---|---|
| DE | 4204308 | | 8/1983 |
| DE | 3633449 | | 4/1987 |
| DE | 4140105 | | 6/1993 |
| DE | 4204308 | | 8/1993 |
| DE | 4325971 | | 2/1995 |
| DE | 19528669 | | 2/1997 |
| DE | 10012941 | | 5/2001 |
| DE | 10306185 | | 7/2006 |
| EA | EP1205606 | | 3/2006 |
| EP | 0336845 | | 10/1989 |
| EP | 1346912 | | 9/2003 |
| EP | 2135536 | | 12/2009 |
| EP | 2233649 | A2 | 9/2010 |
| FR | 2709940 | | 3/1995 |
| FR | 2834196 | | 7/2003 |
| FR | 2846551 | | 5/2004 |
| GB | 380831 | | 9/1932 |
| GB | 2126888 | A | 4/1984 |
| GB | 2146522 | | 4/1985 |
| GB | 2243546 | | 11/1991 |
| GB | 2266662 | | 11/1993 |
| GB | 2412582 | | 10/2005 |
| GB | 2454228 | | 5/2009 |
| WO | WO03082068 | | 10/2003 |

OTHER PUBLICATIONS

IPRP2 in PCTEP2013073837 dated Dec. 19, 2014, pp. 7 to 14.
Search Report in EP12169017 dated Sep. 26, 2012, pp. 15 to 16.
Search Report in EP12190932 dated Apr. 8, 2013, pp. 17 to 18.
Search Report in EP13150090 dated May 31, 2013, pp. 19 to 20.
Search Report in PCTEP2013054538 dated Aug. 26, 2013, pp. 21 to 24.
Search Report in PCTEP2013071025 dated Jan. 17, 2014, pp. 25 to 33.
Search Report in PCTEP2013073837 dated Feb. 25, 2014, pp. 34 to 37.
Written Opinion in EP12169017 dated Sep. 26, 2012, pp. 38 to 39.
Written Opinion in EP12190932 dated Apr. 8, 2013, pp. 40 to 40.
Written Opinion in EP13150090 dated May 31, 2013, pp. 41 to 44.
Written Opinion in PCTEP2013054358 dated Aug. 26, 2013, pp. 45 to 49.
Written Opinion in PCTEP2013071025 dated Jan. 17, 2014, pp. 50 to 56.
Written Opinion in PCTEP2013073837 dated Feb. 25, 2014, pp. 57-63.
Co-pending Application: Applicant: Shankar et al., U.S. Appl. No. 14/385,542, filed Sep. 16, 2014.

* cited by examiner

SUSTAINABLE MINI SHOWER

FIELD OF THE INVENTION

The invention relates to personal cleansing apparatus and more particularly to sustainable mini shower which can be used for cleaning a part of the body such as face and hands.

BACKGROUND OF THE INVENTION

Showers can be found in houses, hotels, hostels and lodges all around the world. Showers consume huge quantity of water.

Portable or hand-held or mini showers provide shower on-the-go for travellers and campers. Such showers are generally used for quickly washing a part of the body such as the hands, face or legs. A typical portable or mini-shower includes a container for holding water, a pipe or a conduit for flow of water, a pressuring means such as a foot-pedal and a shower head.

A full-body shower consumes upwards of fifty liters of water. Known mini showers also need around three to five liters of water for one-time use and usually a device, once pressurised, provides a spray of water for very short duration. Therefore people tend to pressurise the container again so that they can have repeat shower. People using portable or mini showers often desire a longer-lasting shower in a single use, but with the disclosed drawbacks and limitations of conventional mini showers, this inherently implies the use of more water.

The concept of sustainable use of natural resources is fast gaining widespread momentum. This can be seen from the fact that some companies have started including elements of sustainability in their corporate agenda and vision. Some companies have also started publishing sustainability reports.

Water is undoubtedly one of the most important natural resources. However, published reports indicate that the daily global consumption of water crosses several hundred thousand liters for showers alone.

Therefore, it is a technical problem to design a mini shower which can meet some opposing demands at the same time. The first demand is to be sustainable. This implies the use of significantly lesser water. The second requirement is to provide a longer-lasting shower after the container of water is adequately pressurised for use.

US patent publications U.S. Pat. No. 3,760,431 B1 (Barry Schwibner, 1973), U.S. Pat. No. 5,161,266 B1 (Hildebrand, 1992) and US2005086738 A1 (Gragtmans Ian) disclose conventional portable showers having a conduit, a conventional shower head, a container and a deformable foot pump for pressurising the container. The mini shower apparatus is designed for washing the hands, the feet or the face.

The limitations of such conventional portable or mini showers have already been described. The typical duration of shower for a one-time use is about 10 seconds to 15 seconds, whereas users desire longer lasting showers once the container is adequately pressurised.

We have now determined that the aforesaid technical problems can be solved by making use of gas to adequately pressurise the water which is then co-dispensed along with water in the form of a mist or spray through a shower head having unique configuration of nozzles.

SUMMARY OF THE INVENTION

In a first aspect disclosed is a sustainable shower apparatus having:

(i) a pressurisable container to hold water and a gas;
(ii) a pressuriser for pressurizing the container;
(iii) a shower head;
(iv) a first tubing for carrying pressurized water from the container to the shower head;
(v) a second tubing for carrying pressurized gas from the container to the shower head;

wherein flow of the gas or the water is individually controllable by use of respective valves of the first tubing and the second tubing and where each tubing terminates into a respective nozzle in the shower head, wherein the shower head comprises a nozzle for spraying the gas and adjacent thereto, at least one nozzle for spraying the water, and wherein tip of nozzle for spraying the water is oriented at an acute angle with tip of nozzle for spraying the gas.

In a second aspect disclosed is a method for a sustainable showering using the shower apparatus of the first aspect, the method having steps:

(i) pressurizing the container comprising water to a desired pressure by using the pressuriser;
(ii) opening the respective valves of the first tubing and the second tubing so as to allow water and gas to flow through the tubings towards the shower head;
(iii) allowing water to be released from the shower head.

The invention will now be explained in details.

DETAILED DESCRIPTION

The Container

The shape, size, dimensions and material of construction of the pressurisable container have no particular role to play. The container must be capable of withstanding applied pressure. It is preferred that the pressurisable container is capable of being pressurized up to 80 psi, more preferably 10 psi to 60 psi and most preferably 20 to 40 psi. It is preferred that the pressurisable container is capable of holding 4 liters to 20 liters water, more preferably 10 liters to 20 liters and most preferably 12 liters to 20 liters.

A function of the container is to hold water. The container should also hold the gas when the container is pressurized by the pressurizer. The ratio of gas to water can be varied to suit individual needs. Usually the water is more than the gas but it is preferred that ratio of water to gas inside the container is 2:1 to 1:4, more preferably 1:2 to 1:4.

The container preferably also includes a pressure gauge. It can be digital or analog. Any suitable pressure gauge can be used which can be placed or fitted at any convenient location.

In addition to the disclosed features, keeping the safety angle in mind, the container also preferably includes a safety mechanism such as a gasket release system.

The Tubings

The apparatus has a first tubing for carrying pressurized water from the container to the shower head. The apparatus also has a second tubing for carrying pressurized gas from the container to the shower head.

The material of construction of the tubing has no particular role to play. It can be anything from rubber to steel to plastic or a composite material.

One end of the first tubing needs to be submerged in water and preferably reaches to the bottom of the container so that all the water can be utilised without any break in continuity of flow of water. The end of the second tubing which is inside the container and meant for carrying pressurized gas from the container to the spray head, remains above the level of the water inside the container.

Valves

The flow of the gas or water is individually controllable by use of respective valves. Using the respective valves allows for variation in the ratio of gas or water as well as flow-rate thereof. The valves can be suitably placed either on the container itself or anywhere along the length of the individual tubing.

The gas inside the container is used not only to pressurize the water so that it can be sprayed by the spray head but also to co-dispense gas and water to so that a mist of water can be sprayed from the shower head. In this mode, the gas valve is opened, fully or partially depending upon the intended pressure and desired flow-rate so as to allow the gas to reach the shower head. The water valve is also opened fully or partially depending upon desired flow-rate and intended pressure. This allows for sustainable use of water.

The valve can also be used as a tool to start or stop the spray from the spray head.

The Spray Head

Each tubing terminates into a respective nozzle in the shower head, which has a nozzle for spraying gas and adjacent thereto, at least one nozzle for spraying the water, wherein tip of each nozzle for spraying water is oriented at an acute angle with the tip of nozzle for spraying gas.

Therefore, in other words, the tubing for carrying the pressurized gas terminates into its respective nozzle and the other tubing for carrying the pressurized water terminates into its respective nozzle or nozzles.

In a preferred embodiment the shower head has three nozzles:

(i) a middle nozzle for spraying gas; and, (ii) two nozzles adjacent thereto, one each on either side thereof, for spraying water, wherein tip of each of the two adjacent nozzles is oriented at an acute angle with the tip of the middle nozzle.

In such cases, the tubing meant for carrying the water bifurcates and terminates into the respective two nozzles meant for spraying water from each such nozzle.

The nozzles can either be oriented horizontally or vertically.

In a highly preferred embodiment, in each set of nozzles, the tip of the nozzle for spraying the gas and the tips of the nozzles for spraying water are not offset. However, it is equally preferred that the tip of the nozzle for spraying the gas terminates a distance of upto 0.4 cm before or upto 1 cm ahead of the tips of each nozzle for spraying water. Outside the preferred range, there is a possibility of inadequate contact of the gas with the water which affects the spray pattern.

It is more preferred that the disclosed acute angle is 20° to 60°. Preferred angles enable better cleansing and targeted delivery of the mist of the gas and water. Angles lower than 20° are less preferred because the spray pattern and reach of the spray is adversely affected. In further preferred embodiments this acute angle is 40° to 50°. The optimal acute angle is 45°. In the case of angles greater than 60° the coverage is more but impact of the mist is lower.

This affects cleansing. At the same time, angles lower than 20° cause a greater impact, which could be found inconvenient by some users. Further, the coverage is lowered.

It is particularly preferred that the nozzles are co-planar. Co-planarity allows water and gas to be sprayed effectively and uniformly, while allowing the mist to be directed properly towards the object.

Preferably the internal diameter of each nozzle is 0.5 mm to 0.8 mm, more preferably from 0.6 mm to 0.7 mm. This provides proper balance between pressure, reach, coverage and cleansing efficacy. When the internal diameter is below 0.5 mm, the shower experience is not pleasurable as a proper mist will not be formed. On the other hand, diameters above 0.8 mm will lead to increased water consumption and create oversized droplets which are difficult to be conveyed by the gas under manageable pressure.

When water turns into a mist, it cools rapidly, especially if the mist traverses a distance of over ten inches. This cooling effect can be used for a refreshingly cool bathing experience in hot or warm climates. It is preferred that the temperature of water is from 10° C. to 60° C. On the other hand, where people prefer hot or warm showers, the in-use temperature needs to be higher. In such cases, it is preferred that in-use temperature, particularly of water is in the range of 40° C. to 60° C. maintained by heating the water appropriately. The disclosed sustainable shower apparatus consumes only upto 200 ml water per minute and therefore it is sustainable option to known mini showers.

When in use, the disclosed sustainable shower apparatus sprays a mist of water for 60 seconds to 300 seconds after being adequately pressurized, e.g. 40 psi.

Pressuriser

Any suitable means can be used to pressurize the container. The means can be electrical or manual. A suitable electrical pressuriser includes a compressor. A preferred manual pressurizer is a foot pedal. Thus preferably, the pressurizer is a foot pedal or a compressor.

The pressuriser preferably also includes a pressure gauge. Any suitable pressure gauge can be used.

Air is the most preferred gas. Equivalents include Oxygen. Any other suitable gas may be used subject to safety compliance for the intended application.

If required, water can also contain small amount of a cleansing composition, such as a shower gel or a perfume or fragrant material.

Method of Use

In a second aspect, disclosed is a method for sustainable showering using the shower apparatus of the first aspect, the method having the steps of:

(i) pressurizing the container containing water to a desired pressure by using the pressuriser;

(ii) opening the respective valves of the first tubing and the second tubing so as to allow water and gas to flow through the tubings towards the shower head; and (iii) allowing water to be released from the shower head.

In a preferred method, the container is pressurised to 10 psi to 40 psi by using the pressurizer. Further preferably, the flow rate of water through the first tubing is maintained in the range of 100 ml/minute to 120 ml/minute.

In use, the user needs to first fill the pressurizable container with enough water, adding any additive such as perfume, if desired. The user then needs to close the valves meant for controlling flow of water and gas. Thereafter, the user needs to pressurize the container by the pressuriser (for example, the foot pedal or the compressor). The pressurizer can be operated until desired pressure is reached which can be read from the gauge. Once the container is pressurized to e.g. 40 psi, the user can open either one or both valves. This cases a mist of pressurized water to be released from the shower head which can be used to cleanse a part of the body such as hands.

The sustainable personal cleansing apparatus, once adequately pressurized, uses upto 200 ml water for one-time use, whereas prior art mini showers use two to three liters of water.

While prior art mini showers last for less than a minute after adequately pressuring the container for a single use, the disclosed apparatus, once pressurized for use, sprays a mist of water for 60 seconds to 300 seconds, preferably 120 seconds to 270 seconds.

DETAILED DESCRIPTION OF DRAWINGS

Figure 1:
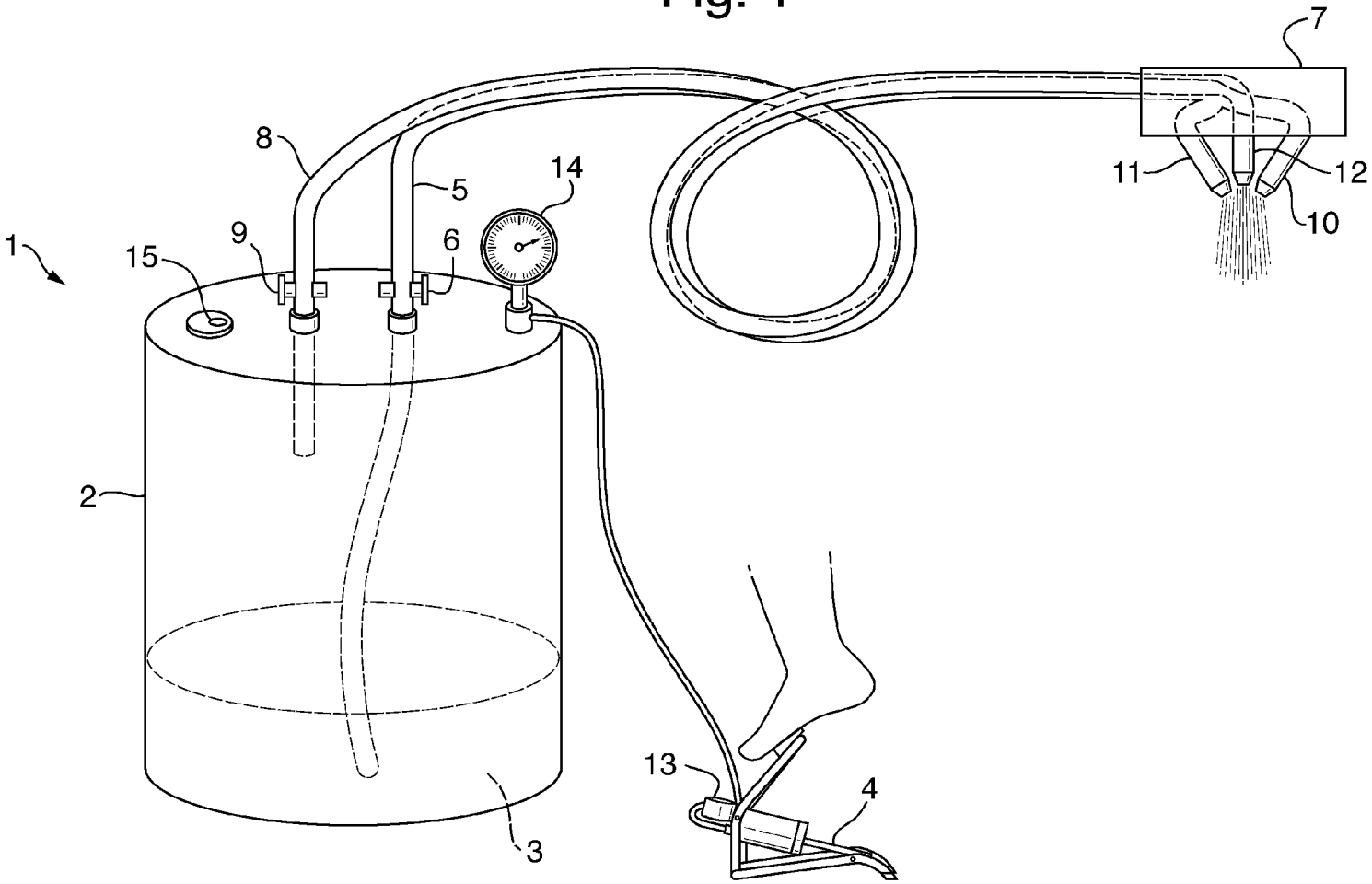
FIG. 1 is a schematic figure of a preferred embodiment of a sustainable shower apparatus.

FIG. 1 is a schematic figure of a preferred embodiment of a sustainable shower apparatus (1). Seen in this schematic figure is a cylindrical pressurisable container (2) which is shown in a vertical sectional view so as to show the interior of the container. The pressurisable container (2) holds some water (3). A manually operated foot pedal (4) serves here as the pressuriser for pressurizing the container (2). A first tubing (5) having valve (6) carries pressurized water from the container to the shower head (7). The apparatus also includes a second tubing (8) for carrying pressurized gas from the container (2) to the shower head (7). The second tubing (7) has its own valve (9). The shower head 7 has a pair of nozzles (10, 11) for spraying water and a nozzle (12) for spraying the gas. The nozzles are adjacent to each other. The tip of the nozzle (12) for spraying the gas is at an acute angle with tip of each nozzle (10, 11) for spraying the water.

The tubing (5) meant for carrying water is bifurcated at the spray head (7) such that water can be sprayed through each nozzle (10, 11).

A pressure gauge (13) is in-built into the foot pedal (4). Another pressure gauge (14) is on the container (2). The container (2) also has a safety valve (15).

In use, the user needs to first fill the pressurizable container (2) with enough water (3), adding any additive such as perfume, if desired. The user then needs to close the valves (6) and (9). Thereafter, the user needs to pressurize the container (2) by operating the foot pedal (4). The applied pressure can be very easily read from the gauge (13). Once the container is adequately pressurized to e.g. 40 psi, the user can open both valves (6, 9) fully or partly to release a mist of pressurized water shower head (7) which can be used to cleanse a part of the body such as hands.

Figure 2:
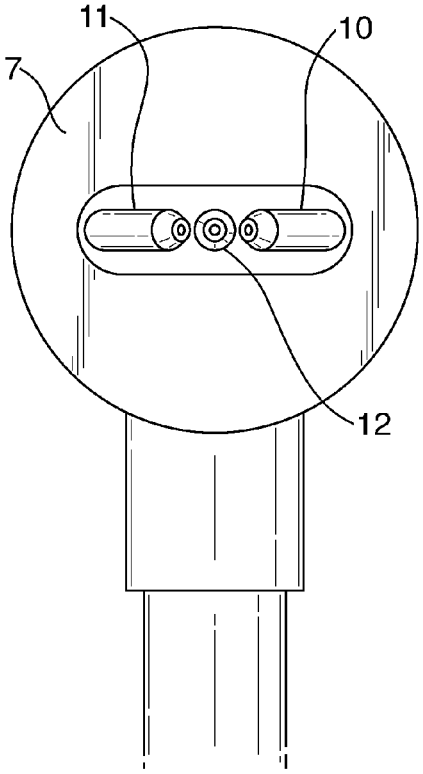
FIG. 2 is front (elevation) view of shower head of the apparatus of FIG. 1.

FIG. 2 is front (elevation) view of shower head of the apparatus of FIG. 1 showing the three nozzles therein.

Figure 3:
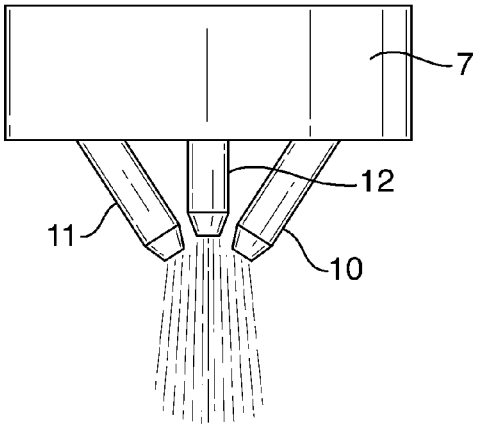
FIG. 3 is top (elevation) view of shower head of FIG. 2.

FIG. 3 is top (elevation) view of shower head of FIG. 2 which shows the acute angles clearly.

Figure 4:
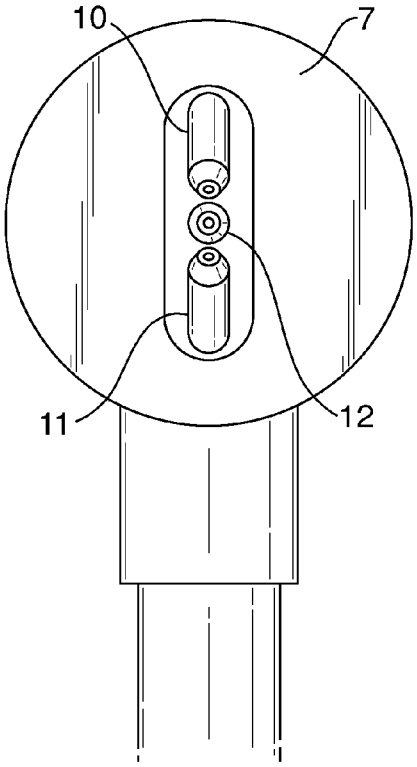
FIG. 4 is a front (elevation) view of alternative shower head.

FIG. 4 is a front (elevation) view of alternative shower head. In this embodiment, the nozzles are arranged in a vertical orientation.

The invention will now be explained with reference to the following non-limiting examples.

EXAMPLES

Example 1

Effect of the Ratio of Water to Air on Duration of Shower Using Apparatus of FIG. 1

| | |
|---|---|
| Total container capacity | 15 liters |
| Container pressurized to | 30 psi |
| Flow rate of water | 100 ml/minute to 120 ml/minute |

TABLE 1

| Volume of water/liters | Volume of air/liters | Ratio of water to air | Duration of shower/minutes |
|---|---|---|---|
| 10 | 5 | 2:1 | 120 |
| 6 | 9 | 2:3 | 150 |
| 5 | 10 | 1:2 | 240 |
| 3 | 12 | 1:4 | 270 |

Data in table 1 indicates that, keeping the pressure constant, an increase in volume of air prolongs the duration of shower while still providing an appreciable flow-rate of water and also at the same time significantly reducing usage of water.

It will be appreciated that the illustrated examples demonstrate how the technical problem of designing a mini shower which meets opposing demands of sustainability and the provision of longer-lasting shower for a one-time use can be solved with the disclosed apparatus.

It should be understood that the specific forms of the invention herein illustrated and described are intended to be representative only as certain changes may be made therein without departing from the clear teachings of the disclosure.

Although the invention has been described with reference to specific embodiments, it will be appreciated by those skilled in the art that the invention may be embodied in many other forms.

The invention claimed is:

1. A sustainable shower apparatus (1) comprising:

(i) a pressurisable container (2) to hold water and gas;

(ii) a pressuriser (4) for pressurizing said container (2);

(iii) a shower head (7);

(iv) a first tubing (5) for carrying pressurized water from the container (2) to the shower head (7);

(v) a second tubing (8) for carrying pressurized gas from the container (2) to the shower head (7);

wherein flow of said gas or said water is individually controllable by use of respective valves (6, 9) of said first tubing (5) and said second tubing (8), where each tubing terminates into a respective nozzle in said shower head, wherein said shower head (7) comprises a nozzle for spraying said gas (12) and adjacent thereto, at least one nozzle (10, 11) for spraying said water, and wherein tip of nozzle (10, 11) for spraying said water is oriented at an acute angle with tip of nozzle for spraying said gas (12).

2. A sustainable shower apparatus as claimed in claim 1 wherein said pressurisable container (2) is capable of holding 4 liters to 20 liters water.

3. A sustainable shower apparatus as claimed in claim 1 wherein said pressurisable container (2) is capable of being pressurized up to 80 psi.

4. A sustainable shower apparatus as claimed in claim 1 wherein said pressurizer (4) is a foot pedal or a compressor.

5. A sustainable shower apparatus as claimed in claim 1 wherein ratio of said water to said gas inside said container is 1:4 to 2:1.

6. A sustainable shower apparatus as claimed in claim 1 wherein during use, said apparatus uses upto 200 ml water per minute.

7. A sustainable shower apparatus as claimed in claim 1 wherein once pressurized for use, said apparatus sprays a mist of water for 60 to 300 seconds.

8. A sustainable shower apparatus as claimed in claim 1 wherein said shower head (7) comprises three nozzles:

(i) a middle nozzle (12) for spraying said gas; and, (ii) two nozzles (10,11) adjacent thereto, one each on either side thereof, for spraying said water, wherein tip of each of said two nozzles (10,11) is oriented at an acute angle with tip of said middle nozzle (12).

9. A sustainable shower apparatus as claimed in claim 8 wherein tip of said middle nozzle (12) terminates a distance of upto 0.4 cm before or upto 1 cm ahead of tip of each nozzle (10,11) for spraying said water.

10. A sustainable shower apparatus as claimed in claim 8 wherein said acute angle is 20° to 60°.

11. A sustainable shower apparatus as claimed in claim 1 wherein internal diameter of each said nozzle is 0.5 mm to 0.8 mm.

12. A method for sustainable showering using said shower apparatus as claimed in claim 1, said method comprising the steps of:

(i) pressurizing said container (2) comprising water to a desired pressure by using said pressuriser (4);

(ii) opening the respective valves (6,9) of said first tubing (5) and said second tubing (8) so as to allow water and gas to flow through the tubings towards the shower head (7);

(iii) allowing water to be released from said shower head (7).

13. A method as claimed in claim 12 wherein said container (2) is pressurized to 10 psi to 40 psi by using said pressurizer (4).

14. A method as claimed in claim 12 wherein flow rate of water through said first tubing (5) is maintained in a range of 100 ml/minute to 120 ml/minute.

* * * * *